US009097467B2

(12) United States Patent
Gradinger et al.

(10) Patent No.: US 9,097,467 B2
(45) Date of Patent: Aug. 4, 2015

(54) HEAT EXCHANGER FOR TRACTION CONVERTERS

(71) Applicant: ABB RESEARCH LTD, Zürich (CH)

(72) Inventors: Thomas Gradinger, Aarau Rohr (CH); Bruno Agostini, Zürich (CH); Marcel Merk, Zürich (CH)

(73) Assignee: ABB RESEARCH LTD, Zurich (CH)

( * ) Notice: Subject to any disclaimer, the term of this patent is extended or adjusted under 35 U.S.C. 154(b) by 346 days.

(21) Appl. No.: 13/851,640

(22) Filed: Mar. 27, 2013

(65) Prior Publication Data

US 2013/0258594 A1 Oct. 3, 2013

(30) Foreign Application Priority Data

Mar. 28, 2012 (EP) ..... 12161699

(51) Int. Cl.
*H05K 7/20* (2006.01)
*F28D 15/02* (2006.01)
(Continued)

(52) U.S. Cl.
CPC ..... *F28D 15/02* (2013.01); *F28D 15/0233* (2013.01); *F28D 15/0266* (2013.01); *F28D 15/0275* (2013.01); *F28D 2021/0029* (2013.01)

(58) Field of Classification Search
CPC . G06F 1/181–1/182; H05K 7/20218–7/20381; H05K 7/20409–7/20418; H01L 23/367–23/3677; H01L 23/473; H01L 23/46–23/467
USPC ..... 361/676–678, 679.46–679.54, 361/688–723; 165/80.1–80.5, 104.33, 185, 165/172–176; 174/15.1–15.3, 16.1–16.3, 174/547, 548; 257/712–722, E23.088
See application file for complete search history.

(56) References Cited

U.S. PATENT DOCUMENTS 6,714,413 B1 * 3/2004 Ghosh et al. ..... 361/700
6,834,713 B2 * 12/2004 Ghosh et al. ..... 165/104.33
(Continued)

FOREIGN PATENT DOCUMENTS

CN 101459375 A 6/2009
EP 2 031 332 A1 3/2009
(Continued)

OTHER PUBLICATIONS

Search Report issued on Sep. 5, 2012, by the European Patent Office for Application No. 12161699.9.

*Primary Examiner* — Anthony Haughton
*Assistant Examiner* — Razmeen Gafur
(74) *Attorney, Agent, or Firm* — Buchanan Ingersoll & Rooney PC

(57) ABSTRACT

A heat exchanger including a first heat exchanger module with a first evaporator channel and a first condenser channel. The first evaporator channel and the first condenser channel are arranged in a first conduit. The first evaporator channel and the first condenser channel are fluidly connected to one another by a first upper distribution manifold and a first lower distribution manifold such that the first evaporator channel and the first condenser channel form a first loop for a working fluid. The first heat exchanger module includes a first evaporator heat transfer element and a first condenser heat transfer element. The heat exchanger includes a second heat exchanger module coupled to the first heat exchanger module by a fluid connection element for an exchange of the working fluid between the first heat exchanger module and second heat exchanger module.

15 Claims, 6 Drawing Sheets

(51) Int. Cl.
*H01L 23/473* (2006.01)
*F28D 21/00* (2006.01)

(56) References Cited

U.S. PATENT DOCUMENTS

| | | | | |
|---|---|---|---|---|
| 7,013,956 | B2 * | 3/2006 | Thayer et al. | 165/104.25 |
| 2004/0011511 | A1 * | 1/2004 | Ghosh et al. | 165/104.21 |
| 2005/0254214 | A1 * | 11/2005 | Salmon | 361/699 |
| 2005/0255722 | A1 * | 11/2005 | Salmon | 439/67 |
| 2006/0162898 | A1 * | 7/2006 | Reyzin et al. | 165/80.4 |
| 2006/0162904 | A1 * | 7/2006 | Bhatti et al. | 165/104.14 |
| 2007/0246193 | A1 * | 10/2007 | Bhatti et al. | 165/104.21 |
| 2007/0246195 | A1 * | 10/2007 | Bhatti et al. | 165/104.33 |
| 2007/0267182 | A1 * | 11/2007 | Rusch et al. | 165/104.33 |
| 2007/0284093 | A1 * | 12/2007 | Bhatti et al. | 165/104.33 |
| 2008/0218970 | A1 * | 9/2008 | Kehret et al. | 361/699 |
| 2008/0236790 | A1 * | 10/2008 | Bhatti et al. | 165/80.3 |
| 2009/0056916 | A1 | 3/2009 | Yesin et al. | |
| 2009/0116192 | A1 * | 5/2009 | McCullough et al. | 361/701 |
| 2009/0120622 | A1 * | 5/2009 | Koch | 165/104.33 |
| 2009/0211743 | A1 * | 8/2009 | Schrader et al. | 165/173 |
| 2010/0044012 | A1 * | 2/2010 | Sharma | 165/104.19 |
| 2010/0270010 | A1 * | 10/2010 | Agostini | 165/104.27 |
| 2010/0277870 | A1 | 11/2010 | Agostini | |
| 2010/0307716 | A1 * | 12/2010 | Bean et al. | 165/80.2 |
| 2011/0030400 | A1 | 2/2011 | Agostini et al. | |
| 2011/0164384 | A1 * | 7/2011 | Vogel et al. | 361/696 |
| 2011/0226445 | A1 * | 9/2011 | Brand | 165/70 |
| 2011/0265975 | A1 | 11/2011 | Koivuluoma et al. | |
| 2011/0315354 | A1 * | 12/2011 | Johnson | 165/104.33 |
| 2012/0000628 | A1 | 1/2012 | Weber et al. | |

FOREIGN PATENT DOCUMENTS

| | | | |
|---|---|---|---|
| EP | 2 246 654 | A1 | 11/2010 |
| EP | 2 282 624 | A1 | 2/2011 |
| EP | 2 284 846 | A1 | 2/2011 |
| EP | 2 375 210 | A1 | 10/2011 |
| EP | 2 383 779 | A1 | 11/2011 |

* cited by examiner

HEAT EXCHANGER FOR TRACTION CONVERTERS

RELATED APPLICATION(S)

This application claims priority to European Application No. 12161699.9 filed in Europe on Mar. 28, 2012. The entire content of this application is hereby incorporated by reference in its entirety.

FIELD

The present disclosure relates in general to a heat exchanger, for example, to a heat exchanger that can be used in a traction converter and to a traction converter.

BACKGROUND INFORMATION

Vehicles and trains are powered with drive systems which can use electric energy converters. There is a market demanding low cost, efficient and reliable converters. In a known system, power-electronic components, such as discrete or integrated (i.e. module type) semiconductor devices, inductors, resistors, capacitors and copper bus-bars, can be assembled in close proximity. During operation, these components can dissipate heat of varying quantities. In addition, these components are tolerant to temperatures of varying levels. Temperature conditions can differ depending on which area of the world the converters are used in. The thermal management and integration concept of a drive system can also consider humidity and other factors in addition to the electrical performance of the system.

The design of trains utilizes equipment which can be arranged on the roof of the train or underneath the floor (for example, in an underfloor converter). Semiconductor components and power resistors can be heat sources of traction converters. They can be built with a plate-mount design to be bolted or pressed onto a flat surface that is kept at a suitably low, relatively cold temperature. Fan-blown-air cooled aluminum heat sinks and pumped water cooled cold plates are examples of a heat exchange surface. Other components such as inductors, capacitors and PCB circuit elements can be cooled by air-flow.

One possibility for achieving environmental protection is to arrange critical electric circuits, including semiconductor components, in protected enclosures. However, removal of heat can get more complicated with higher protection of the components.

The degree of environmental protection that is offered by an electronic product can be expressed in terms of its "Ingress Protection (IP) Rating." Many drive products are offered in IP20 or IP21 as standard with IP54 or higher protection ratings offered as optional. With lower IP ratings it is possible to design for through-flow of outside air within the drive enclosure while still providing adequate protection. Air filters can be employed to reduce the particles in the air. Down-facing air-vents on the enclosure walls can prevent vertical water droplets from entering. With higher IP ratings, however, separation of outside air from the inside air of the drive enclosure becomes desirable. For the highest protection levels, like IP65 or even more, a water-tight enclosure can become desirable.

An air-to-air heat-exchanger can be employed in high IP rated enclosures in order to dissipate heat to the ambient while separating the cabinet internal and external air volumes. Heat-pipes and thermoelectric cooling elements can also be used in such devices.

EP2031332 shows a heat exchanger using air cooling. The device disclosed in EP2031332 is a thermosyphon heat exchanger for traction converters. However, the Ingress Protection offered by the disclosed system is still limited. Furthermore, there exists a need for a more compact and more efficient system to cool heat sources of the power modules of a train.

SUMMARY

A heat exchanger is disclosed, comprising: a first heat exchanger module including: a first evaporator channel and a first condenser channel wherein the first evaporator channel and the first condenser channel are arranged in a first conduit and wherein the first evaporator channel and the first condenser channel are fluidly connected to one another by a first upper distribution manifold and a first lower distribution manifold such that the first evaporator channel and the first condenser channel form a first loop for a working fluid; a first evaporator heat transfer element for transferring heat into the first evaporator channel; and a first condenser heat transfer element for transferring heat out of the first condenser channel; a second heat exchanger module coupled to the first heat exchanger module by a fluid connection element for an exchange of the working fluid between the first heat exchanger module and second heat exchanger module, the second heat exchanger module including: a second evaporator channel and a second condenser channel, wherein the second evaporator channel and the second condenser channel are arranged in a second conduit and wherein the second evaporator channel and the second condenser channel are fluidly connected to one another by a second upper distribution manifold and a second lower distribution manifold such that the second evaporator channel and the second condenser channel form a second loop for the working fluid, the second condenser channel is arranged opposite to the first evaporator channel with respect to the first condenser channel when seen in a virtual plane to which the first condenser channel and the second condenser channel and the first evaporator channel are projected.

BRIEF DESCRIPTION OF THE DRAWINGS

Exemplary embodiments are depicted in the drawings and are detailed in the description which follows. In the drawings.

In the Figures, same reference numerals denote same or similar parts.

DETAILED DESCRIPTION

Figure 1:
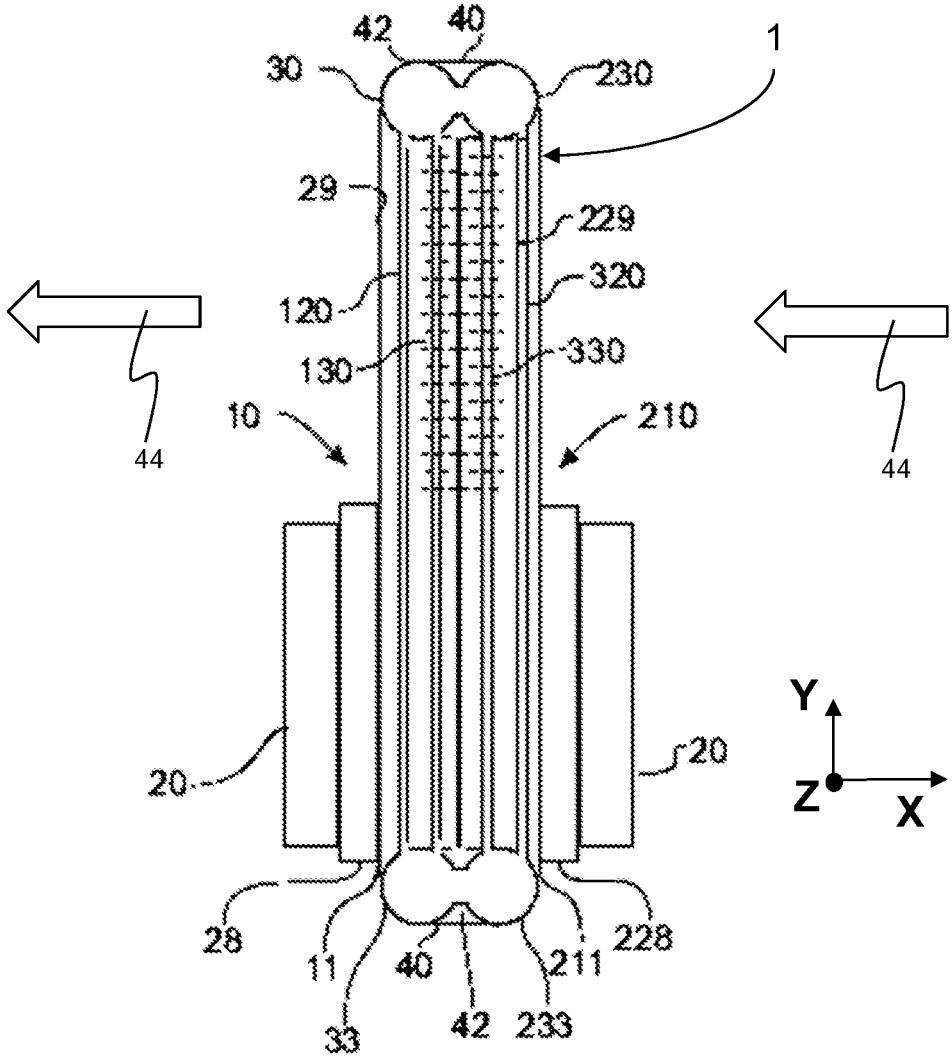
FIG. 1 illustrates a first embodiment of a heat exchanger according to the disclosure in a schematic cross-sectional view.

Exemplary embodiments of the present disclosure can provide a more efficient or more compact heat exchanger and traction converter with the possibility of providing high ingress protection.

According to an embodiment of the disclosure disclosed herein, a heat exchanger is provided, including a first heat exchanger module with a first evaporator channel and a first condenser channel, wherein the first evaporator channel and the first condenser channel are arranged in a first conduit. The first evaporator channel and the first condenser channel are fluidly connected to one another by a first upper distribution manifold and a first lower distribution manifold such that the first evaporator channel and the first condenser channel form a first loop for a working fluid. The first heat exchanger module includes a first evaporator heat transfer element for transferring heat into the first evaporator channel, and a first condenser heat transfer element for transferring heat out of the first condenser channel. The heat exchanger includes a second heat exchanger module coupled to the first heat exchanger module by a fluid connection element for an exchange of the working fluid between the first heat exchanger module and second heat exchanger module.

Exemplary heat exchangers disclosed herein allow the use of a two-phase heat transfer principle in order to efficiently remove the input heat without the need for a pumping unit if the conduit is oriented relative to earth's gravitational force such that the working fluid movement can be driven by gravity. This can result in cost reduction and reliability improvement. Pumpless systems can be desirable as pumps are prone to attrition leading to maintenance. A thermosyphon-type heat-exchanger principle is used, wherein the cooling performance and compactness are increased by adding a second heat exchanger module to the first heat exchanger module. The heat exchanger modules are coupled for a heat transfer between the heat exchanger modules. Thereby, different heating or cooling conditions can be balanced between the modules, wherein a better overall performance is achieved.

In exemplary embodiments according to the disclosure, the second heat exchanger module includes a second evaporator channel and a second condenser channel. The second evaporator channel and the second condenser channel are arranged in a second conduit. The second evaporator channel and the second condenser channel are fluidly connected to one another by a second upper distribution manifold and a second lower distribution manifold such that the second evaporator channel and the second condenser channel form a second loop for the working fluid.

In exemplary embodiments according to the disclosure, the heat exchanger modules have separate housings or have separate conduits. Each of the first and second heat exchanger modules can be suitable for a stand-alone operation, especially in case it is not connected to the other one of the heat exchanger modules. Expressed in other terms, an exemplary embodiment of the heat exchanger according to the disclosure includes at least two heat exchanger modules that are basically operable independently of one another in an operating state of the heat exchanger modules. For example, when a heat source is feeding a thermal load to the working fluid and where the thermal load is released in a condenser section thereafter such that the working fluid that is vaporized at the evaporator section is liquefied in the condenser section and fed back to the evaporator section where the cycle starts anew.

Exemplary embodiments of the present heat exchanger according to the disclosure include first and second heat exchanger modules, which are both suitable for being operated independently. Exemplary embodiments use at least substantially identical heat exchanger modules as first and second heat exchanger modules. In an exemplary embodiment according to the disclosure, the second heat exchanger module includes features being described herein for the first heat exchanger module. Thereby, costs can be reduced by using standard items. Heat exchanger modules being suitable for a stand-alone operation can also be sold as single heat exchangers for cooling situations where less cooling is needed. Therefore, with only a few parts a broad application range can be covered.

The heat exchangers and traction converters described herein can be employed for cooling electric circuit components, for example, for cooling low voltage AC drive systems, such as electrically powered vehicles like trains or cars. The heat exchanger modules can be used as a loop-thermosyphon configuration by separating the upstream and downstream fluid streams in separate channels of a multi-port conduit. Different numbers and sizes of channels can be used for the up-going and down-coming streams in order to optimize the boiling and condensation performance in the heat exchanger modules.

The features described in connection with the first heat exchanger module apply similarly to the second heat exchanger module. However, the number of upstream or downstream channels or the dimensions of the heat exchanger modules can be different. In an exemplary embodiment according to the disclosure, heat exchanger modules having identical dimensions are used. Thereby, a mechanical coupling of the modules is made easy.

In an exemplary embodiment according to the disclosure, the evaporator heat transfer element includes a mounting element having a mounting surface for mounting the heat generator, and a contact surface for establishing a thermal contact to a portion of the exterior wall of the conduit associated with the evaporator channel. Herein, the term "evaporator heat transfer element" is used for the first evaporator heat transfer element, the second evaporator heat transfer element, both or all evaporator heat transfer elements.

The first evaporator channel and the first condenser channel are aligned in parallel in the first conduit in an exemplary embodiment according to the disclosure. By aligning the channels in parallel, a compact exchanger module can be achieved. Exemplary embodiments described herein can provide an evaporator channel having a larger overall cross-sectional area than the one of the corresponding condenser channel. If the conduit is a multiport conduit, for example, an extruded aluminum profile having a plurality of longitudinal sub-channels that are separated from one another by an interior wall of the conduit, such conduits also being known as MPE profiles, then more sub-channels can be used for forming the evaporator than to the ones forming the condenser. However there can be more condenser sub-channels than evaporator sub-channels allocated in a multiport profile, for example. Thereby, the heat exchanger modules can be adapted to different thermal conditions.

If an efficient heat transfer shall be achieved for releasing a thermal load of the working fluid that was received at the evaporator portion then it is desirable if the first and/or the second condenser heat transfer element includes cooling fins provided on a portion of the exterior wall of the conduit for increasing the outer overall surface of the condenser. These cooling fins can be present only on a portion of the exterior wall of the conduit associated with the condenser channel such that an efficient heat transfer from the working fluid to the environment can be achievable. Having fins on the exterior wall of the conduit associated with the evaporator channel can be regarded as disadvantageous because it might promote condensation of the working liquid already on its way up to the upper distribution manifold leading to a suboptimal thermal performance. Thus the evaporator channel portion in the area of the condenser portion of the heat exchanger is employed merely as vapor riser for leading vapor from the evaporator portion to the upper distribution manifold—ideally without causing vapor condensation.

In the following descriptions, the terms "first evaporator channel", "first condenser channel", "second evaporator channel", and "second condenser channel" can include more than one channel, respectively, where the cooling performance requires so. In an exemplary embodiment, features of the first heat exchanger module can be present similarly at the second heat exchanger module. An exemplary embodiment of the heat exchanger includes a first conduit that has a plurality of first evaporator channels and a plurality of first condenser channels. An exemplary embodiment of the heat exchanger according to the disclosure includes a further conduit, for example, a second conduit that includes a plurality of second evaporator channels and a plurality of second condenser channels, too.

In an exemplary embodiment according to the disclosure, the respective conduits and channels of the second heat exchanger module can be arranged similar to the conduits and channels of the first heat exchanger module. In an exemplary embodiment according to the disclosure, each of the heat exchanger modules includes a plurality of conduits. The conduits of the heat exchanger modules are arranged in parallel rows in exemplary embodiments according to the disclosure. In a back-to-back arrangement of the heat exchanger modules, the conduits of the respective heat exchanger modules can be arranged mirror-inverted with the respective evaporation and condenser channels. In an exemplary embodiment of the disclosure, the second condenser channel can be arranged opposite to the first evaporator channel with respect to the first condenser channel when seen in a virtual plane to which the first condenser channel and the second condenser channel and the first evaporator channel are projected.

Exemplary embodiments according to the disclosure include arrangements with the first condenser channel and the second condenser channel being arranged between the first evaporator channel and the second evaporator channel. With these arrangements, compact heat exchangers can be provided.

By arranging the first heat exchanger module and the second heat exchanger module parallel in an at least substantially upright position, a good thermal efficiency can be achieved. In this context, "substantially" denotes classic positions with a maximum declination of 10° or of 5° with respect to the vertical. The parallel arrangement helps to achieve a compact construction. In an exemplary embodiment according to the disclosure, the heat exchanger modules can be arranged such that the respective conduits of the heat exchanger modules are aligned parallel. In exemplary embodiments according the disclosure, the heat exchanger modules are arranged back-to-back. By doing so, a thermal contact between the heat exchanger modules can be established. The "back" of an exchanger module can denote the side opposite to the side where the evaporator heat transfer element of the exchanger module is arranged. In an exemplary embodiment according to the disclosure the evaporator heat transfer element can be arranged between the conduit and the heat source for transferring heat from the heat source to the conduit. The heat source of a power module can be formed by components of an electric circuit, for example, semiconductor elements like IGBTs, thyristors, power resistors or other electrical components producing heat during operation.

Exemplary embodiments according to the disclosure include a mounting element with a base plate having a planar mounting surface for mounting the heat generator. Opposite to the planar mounting surface, a contact surface can be provided on the base plate, the contact surface having at least one groove matching size and shape of a portion of the exterior wall of the conduit to be thermally and mechanically connected thereto. Thus, the exchanger module is designed to efficiently discharge the heat generated by flat-plate mounted components, for example, to the ambient air while also allowing for the separation of the air volumes inside and outside the system enclosure. The planar exterior sidewalls of the flat tube can be oriented perpendicular to the planar mounting surface of the base plate. In exemplary embodiments according to the disclosure, the mounting element includes at least one mounting hole or at least one mounting slot on the mounting surface. In exemplary embodiments according to the disclosure, the conduit is a flat multi-port profile including several sub-channels that are fluidly separated to a neighboring sub-channel by an interior wall of conduit, each, wherein the conduit has planar exterior sidewalls. Such a conduit provides a high heat-transfer coefficient to air with small pressure drop in the air flow and in a compact size.

In an exemplary embodiment according to the disclosure, a first upper distribution manifold is connected to an upper end of the first conduit and a second upper distribution manifold is connected to an upper end of the second conduit, the first upper distribution manifold and the second upper distribution manifold being connected by an upper fluid connection. Exemplary embodiments according to the disclosure described herein include a first lower distribution manifold being connected to a lower end of the first conduit and a second lower distribution manifold being connected to a lower end of the second conduit, the first lower distribution manifold and the second lower distribution manifold being connected by a lower fluid connection. The term "a fluid connection" should be construed as encompassing more than one fluid connection. Hence, the upper fluid connection element and the lower fluid connection element are encompassed by the term "a fluid connection element".

In exemplary embodiments according to the disclosure, the distribution manifolds connect the evaporation channels with the condenser channels closing the loop for the working fluid. The terms "upper" and "lower" refer to the direction of the channels in the conduits, i.e. upwards is the direction of the evaporating working fluid and downwards is the direction of the condensing working fluid.

By coupling the distribution manifolds of at least two thermosiphon heat exchangers that can be operated independently of one another, when not yet coupled, a heat exchange between the heat exchanger modules can be established. A motivation for exemplary embodiments of the present disclosure arose from a thermosiphon heat exchanger whose condenser portions were arranged in a stacked manner to one another such that a thermal carrier, for example, air, could pass a condenser section of the first heat exchanger module first and the condenser for the second heat exchanger thereafter. Due to that sequential passing of the first heat exchanger module and the second heat exchanger module, the thermal carrier already received a first thermal load from the first heat exchanger module before it passes the second heat exchanger module. Expressed in other words, in an embodiment where the thermal carrier is air, the temperature of the air, after passing the second heat exchanger, was higher than after passing the first heat exchanger module, because it had been pre-heated by the first heat exchanger module. The thermal situation of a stacked set of heat exchanger modules is such that the heat exchanger module being arranged downstream of the thermal carrier has a higher saturation temperature of the working fluid or refrigerant compared to the heat exchanger module being arranged upstream of the thermal carrier. That results in a module temperature of the downstream heat exchanger module being higher than the upstream heat exchanger module.

By fluidly connecting the heat exchanger modules, the saturation pressure and thus the module temperature is the same in both heat exchanger modules in an operating state. Thus, a temperature rise of the thermal carrier going through the condenser regions of the two heat exchanger modules is equally distributed between both heat exchanger modules. As a result, the heat exchanger according to exemplary embodiments of the disclosure allows a thermally efficient cooling even when different electric and/or electronic components are thermally connected to the different heat exchanger modules.

Hence, in an exemplary embodiment according to the disclosure, the heat exchanger modules are arranged such that a row of multiple conduits of the exchanger module is aligned perpendicular to the air flow. Thereby, each of the conduits in the row can be subjected to at least nearly the same thermal conditions. In a back-to-back arrangement of two heat exchanger modules, the row of the second conduits of the second heat exchanger module is in the direction of the air flow located behind the row of the first conduits of the first heat exchanger module. Although the second conduits of the second heat exchanger module are subjected to pre-warmed thermal carrier (for example, air), all second conduits of the second heat exchanger module have similar thermal conditions. By establishing a fluid connection for the working fluid between the heat exchanger modules via the fluid connection element, thermal differences between the heat exchanger modules can be balanced.

A positive side effect resides in that the fluid coupling allows for compensating heat loads of different sizes at the first and second heat exchanger modules in an operating state of the thermosiphon heat exchanger and power module. If more working fluid in its liquid state is required at an evaporator of one heat exchanger module it can be supplied by the other heat exchanger module and vice versa. If the heat source of the first heat exchanger module produces more vapor than the heat source that is thermally coupled to the second heat exchanger module, the working fluid can pass from the first heat exchanger module to the second heat exchanger module (in the upper distribution manifold) and cooled fluid can be passed from the second heat exchanger module to the first heat exchanger module (in the lower distribution manifold). The heat exchanger therefore works more efficient with the distribution manifolds in fluid connection.

In an exemplary embodiment, a fluid connection element can be realized with at least one hole formed in the respective distribution manifolds. Exemplary embodiments according to the disclosure include a manifold connector for connecting distribution manifolds. The manifold connecter can have an I-like form with holes in it for an exchange of the working fluid between the distribution manifolds. Thereby, a mechanically stable arrangement is achieved.

In exemplary embodiments according to the disclosure, the fluid connection element includes an upper connecting pipe for connecting the upper distribution manifolds or a lower connecting pipe for connecting the lower distribution manifolds. With connecting pipes, the fluid connection element of the two heat exchanger modules is easy to establish.

In an exemplary embodiment of the heat exchanger according to the disclosure, the mounting elements can be made of aluminum or copper. Furthermore, the conduits can be made of aluminum, such as brazed aluminum, for example, common in automotive industry, for reduced manufacturing cost, small size and good thermal-hydraulic performance. Exemplary embodiments of the disclosure are suitable for automated manufacturing with heat-exchanger core assembly machines, commonly used in the automotive cooling industry. Such re-use of available series production equipment can reduce costs.

In exemplary embodiments according to the disclosure, the heat exchanger includes a separation element for separating a first environment from a second environment, whereby the temperature of the first environment is higher than the temperature of the second environment. For example, the first environment can be a so called clean room containing the heat source, for example, electronic components or electrical devices, and the second environment can be a so called dirty room. In the dirty room, the first and second condenser heat transfer elements can be arranged for transferring heat from the working fluid in the conduit to an ambient fluid in the dirty room. The ambient fluid can be air or water.

In an exemplary embodiment according to the disclosure, the separation element includes a sealing plate, wherein the sealing plate is coupled to the first heat exchanger module and the second heat exchanger module by a sealing. The sealing plate with the sealing usually provides an Ingress Protection of IP64 or more (like IP65 or IP67), i.e. the dirty room of exemplary embodiments can even be flooded with water without affecting the components in the clean room. Thereby, a highly reliable converter system can be provided. In exemplary embodiments according to the disclosure, an outer sealing is provided on the circumference of the sealing plate. Thereby, the clean room can be sealed completely with respect to the dirty room. In exemplary embodiments, a further sealing plate can be arranged at the top of the heat exchangers. The further sealing plate can be arranged directly below the distribution manifolds, around the distribution manifolds or directly above the distribution manifolds. Sealing plates can be, for example, U-shaped in order to provide an adequate surface for sealing. The sealing plates are mounted to the heat exchangers in exemplary embodiments according to the disclosure for providing a compact part which can be replaced easily.

Exemplary embodiments of the disclosure can refer to a heat exchanger having a height of less than 700 mm, less than 600 mm or less than 500 mm. Such dimensions permit mounting the heat exchanger on the roof of a train or tramway or people-mover or even underneath the floor structure of the vehicle, for example, in a so-called underfloor power converter. The height can be measured in the direction of the conduits or the channels thereof. An exemplary embodiment of a heat exchanger according to the present disclosure includes a duct portion. The duct portion can form a part of a duct for channeling and guiding the thermal carrier through the condenser portion of the first and second heat exchanger module wherein further duct portions that are neighboring the duct portion of the power module or thermosiphon heat exchanger are provided in and belong to a higher entity, for example an overall structure of a traction converter. Depending on the demands and requirements on the power module the duct portion can be a tunnel-shaped structure that delimits the flow of a thermal carrier laterally in all directions in an operating state of the power module.

Alternatively, the duct portion of the power module can include only one or several separation elements, for example, an upper duct wall and a lower duct wall whereas the overall structure provides the remaining structural elements. In such an embodiment the tunnel-shaped duct proximate to the condenser portion of the first and second heat exchanger module can be present only if the power module is mounted at its dedicated position within the overall structure. In such an exemplary embodiment a first a separation element is arranged above the first and second evaporator heat transfer elements and a second separation element is arranged below the first and second condenser heat transfer elements.

Tests have proven that satisfactory exemplary embodiments of heat exchangers according to the disclosure are achievable if the evaporator section with the heat transfer elements is designed to be about twice (±10%) as long as the condenser section of a first and/or conduit when seen in a longitudinal direction of the conduit defined by its shape. Hence the height of the duct portion will match the size of the condenser section as much as possible. Because the evaporator dimension can be given by the components to be cooled, a compact heat exchanger and a compact traction converter can be achievable that way.

In an exemplary embodiment according to the disclosure, components of the heat exchanger can be produced by joining them together in a one-shot oven brazing process. Furthermore, the components of the heat exchanger can be covered with brazing alloy, for example, an AlSi brazing alloy, before the brazing process. In exemplary embodiments according to the disclosure, a flux material is applied to the components of the heat exchanger before the brazing process and the brazing process is conducted in a non-oxidizing atmosphere.

In an exemplary embodiment of the disclosure, all components, other than the mounting element, can be joined in a one-shot oven brazing process and the mounting element is pressed onto the exterior walls of the conduits with thermally conductive gap filling material in between.

An exemplary embodiment according to the disclosure relates to a traction converter with a heat exchanger in one of the described exemplary embodiments. Such a traction converter can be compact, reliable and efficient. The traction converter can include a dirty room and a clean room. The dirty room and the clean room can be divided by the sealing plate or the separation element. In the dirty room, a fan can be arranged for blowing air through the heat exchanger modules. At the air inlet of the dirty room, a particle filter can be provided for hindering bigger particles from entering the dirty room. The heat exchanger can be arranged between the particle filter and the fan, wherein two heat exchanger modules can be arranged one behind the other in the air flow produced by the fan during operation.

Exemplary embodiments of a traction converter include a recess with an opening to one side, wherein the heat exchanger is mountable into the recess through the opening. The heat exchanger modules can be arranged back to back and parallel to the direction of travel of the vehicle in which the traction converter is used. The heat exchanger can be mounted from one side of the vehicle. Thereby, a fast and easy replacement of the traction converter is possible. Further exemplary embodiments according to the disclosure use other alignments of the heat exchanger, for example, perpendicular to the direction of travel.

The use of a heat exchanger according to one of the described exemplary embodiments in a traction converter is a further aspect of the disclosure.

In the Figures, same reference numerals denote same or similar parts.

FIG. 1 illustrates a first exemplary embodiment of a heat exchanger 1 in a schematic cross-sectional view. The heat exchanger includes two substantially identical heat exchanger modules, namely the first heat exchanger module 10 and the second heat exchanger module 210 arranged back-to-back. The first heat exchanger module includes a row of first conduits 11 and the second heat exchanger module comprises a row of second conduits 211. The direction of each row is perpendicular to the plane of projection of FIG. 1. The conduits 11, 211 of the heat exchanger modules 10, 210 of the exemplary embodiment shown in FIG. 1 can be mechanically coupled, for example, welded together or coupled by flanges with screws. In the conduits 11, 211 a working fluid can be evaporated and condensed. The evaporation takes place during operation due to heat being transferred to the conduits 11, 211 from heat sources 20.

For transferring heat from the heat sources 20 to the conduits 11, 211, first and second evaporator heat transfer elements 28, 228 are arranged on a lower part of the conduits 11, 211. The lower parts of the conduits 11, 211 can also be denoted as the evaporation parts. On an upper part of the conduits 11, 211 serving as condenser region, first and second condenser heat transfer elements 29, 229 are arranged for transferring heat from the condenser portion of the conduits 11, 211 to the environment, for example, a thermal carrier 44 like a flow of cooling air. The first and second condenser heat transfer elements 29, 229 are formed by cooling fins 29, 229 that are arranged between the neighboring conduits 11, 211 of the heat exchanger modules 10, 210 when seen in the direction Z. The heat transfer elements 29, 229 can be formed of a zig-zag shaped metal strip that is thermally connected to the conduit 11, 211. The heat transfer elements 29, 229 should not extend over the vapor risers, for example, the evaporator channels above the heat transfer elements 28, 228. The first heat exchanger module 10 includes first evaporator channels 120 and first condenser channels 130, wherein the first evaporator channels 120 and the first condenser channels 130 are arranged in the first conduits 11. There are more than one conduit 11 and more channels 120, 130. However, in the cross-sectional view of FIG. 1, only one conduit is displayed as FIG. 1 is a simplified sectional view through the heat exchanger 1 and the power module 100 in a virtual (sectional) plane. The first evaporator channels 120 and the first condenser channels 130 form a vital part of the first loop for the working fluid. Likewise, the second heat exchanger module 210 include second evaporator channels 320 and second condenser channels 330, wherein the second evaporator channels 320 and the second condenser channels 330 are arranged in the second conduits 211. The second evaporator channels 120 and the second condenser channels 130 form a vital part of the second loop for the working fluid.

FIG. 1 is a simplified cross-sectional view through the heat exchanger 1 of a power module 100 in a virtual plane. Although the first condenser channel 130 and the second condenser channel 330 and the first evaporator channel 120 and the second evaporator channel 320 are visible in the virtual plane view shown in FIG. 1, these evaporator channels 120, 320 and condenser channels 130, 330 can be displaced to one another in the Z-direction, depending on the embodiment and circumstances. Hence FIG. 1 represents a cross-sectional view through the heat exchanger 1 of a power module 100 in a virtual plane to which the first condenser channel 130, the second condenser channel 330, the first evaporator channel 120 and the second evaporator channel 320 are projected in the direction of Z.

Exemplary embodiments according to the disclosure, having a back-to-back arrangement of heat exchanger modules, can provide a good heat transfer for both heat exchanger modules due to a thermal balance between the modules. A thermal coupling of the first heat exchanger module with the second heat exchanger module for promoting a heat transfer between the heat exchanger modules can be achievable in many ways, for example, by mechanically fastening the distribution manifolds to one another by means, e.g. by welding or screwing, or by establishing a direct fluid connection via a fluid connection element for the working fluid, or by a combination of mechanical and hydraulic coupling. In case one of the heat exchanger modules is cooled less intensively than the other, or the heat source of one of the heat exchanger modules produces more heat than the other, the exemplary embodiments enable a heat transfer between the heat exchanger modules such that both heat exchanger modules can operate with efficient conditions. Each of the heat exchanger modules can also be used as stand-alone heat exchanger.

The heat exchanger 1 of FIG. 1 includes a first upper distribution manifold 30, a second upper distribution manifold 230, a first lower distribution manifold 33 and a second lower distribution manifold 233. The distribution manifolds 30, 33, 230, 233 are mounted to the respective ends of the conduits 11, 211 of the heat exchanger modules 10, 210. Each of the distribution manifolds 30, 33, 230, 233 is fluidly connected to the conduits 11, 211 with its evaporator and condenser channels 120, 130, 320, 330 of. Thereby, a first loop and a second loop for working fluid can be established. The upper distribution manifolds 30, 230 are connected for a fluid transfer between the first heat exchanger module 10 and the second heat exchanger module 210 at the upper end of the channels 120, 130, 320, 330 of the respective conduits 11, 211. The lower distribution manifolds 33, 233 are connected for a fluid transfer between the first heat exchanger module 10 and the second heat exchanger module 210 at the lower end of the channels 120, 130, 320, 330 of the respective conduits 11, 211. Thereby, different thermal conditions can be balanced. Between the upper distribution manifolds 30, 230, a manifold connector 40 with connecting holes 42 is arranged. Another, identical manifold connector 40 with connecting holes 42 is arranged between the lower distribution manifolds 33, 233. The manifold connectors 40 allow a fluid transfer between the respective distribution manifolds 30, 33, 230, 233.

Figure 2:
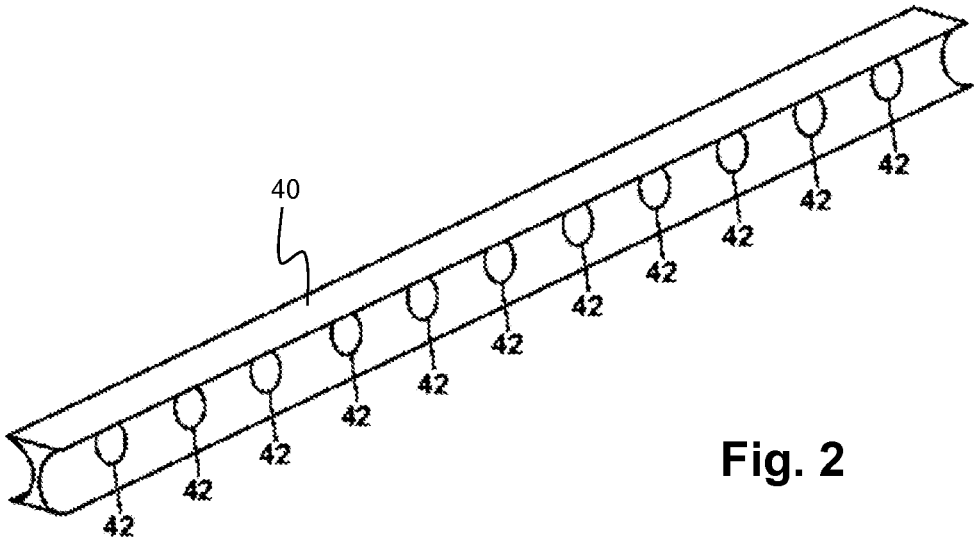
FIG. 2 shows a detail of the embodiment shown of FIG. 1 in a schematic view.

FIG. 2 shows, in a schematic view, a detail of the embodiment shown of FIG. 1. Some parts of the heat exchanger 1 of FIG. 2 can be the same parts as used with the heat exchanger of FIG. 1. Therefore, not all of them are described again in detail. FIG. 2 shows the manifold connector 40 with the connecting holes 42. The connecting holes 42 correspond with openings in the exterior walls of the distribution manifolds 30, 33, 230, 233 (FIG. 1). With this arrangement, an upper fluid connection between the distribution manifolds 30, 33 and a lower fluid connection between the distribution manifolds 30, 33, 230, 233 can be established.

Figure 3:
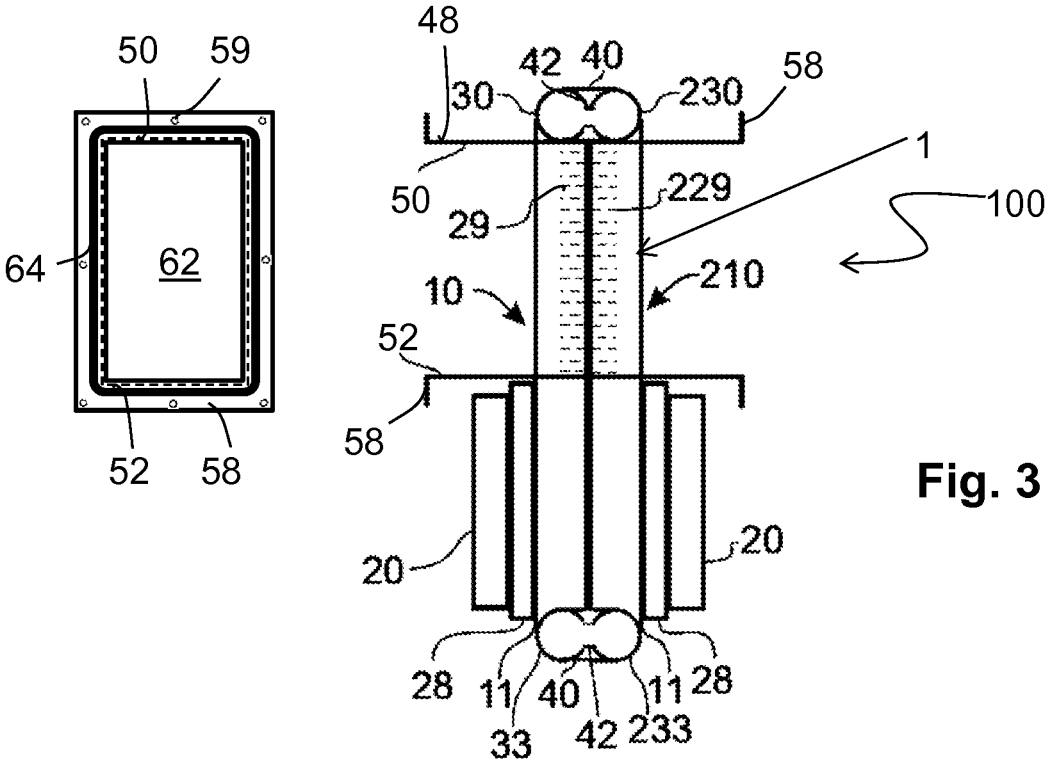
FIG. 3 shows an embodiment of a heat exchanger according to the disclosure in a schematic cross-sectional view.

FIG. 3 shows an exemplary embodiment of a heat exchanger according to the disclosure in a schematic cross-sectional view. Reference is made to the description of the embodiment shown in FIG. 1 since some parts of the embodiment shown in FIG. 3 correspond to the respective parts shown in FIG. 1. For clarity reasons, FIG. 3 does not show the channels of the conduits. The embodiment shown in FIG. 3 does, however, include evaporator and condenser channels.

The embodiment shown in FIG. 3 includes a longitudinal portion of an air duct 48 whereof the horizontally extending side walls that delimit the air duct 48 are referred to as upper duct wall 50 and as lower duct wall 52 hereinafter. The lower duct wall 52 separates a first environment (outside the duct 48, for example inside an overall structure) from a second environment 62 (inside the duct 48). The vertically extending side walls of the duct 48 are indicated in the invisible line style in the draw-out section of the flange portion 58 shown on the left of main FIG. 3, wherein the extracted partial view on the left of FIG. 3 is a partial view to the power module 100 when seen from the right to of main FIG. 3, for example. At the same time the flange portion 58 includes a seal 64, for example, an endless O-ring seal embedded in an appropriate groove, and a suitable connector 59, for example, bolt holes, for mechanically fastening the longitudinal portion of an air duct 48 to a neighboring structure, for example, an overall structure of a power converter, as well as for fluidly sealing the two environments from one another.

When seen in the partial sectional view of FIG. 3 the lower duct wall 52 is arranged just above the evaporator part, i.e. above the first and second evaporator heat transfer element 28, 228, and below the first and second condenser heat transfer element 29, 229. Thereby, the lower duct wall 52 separates a warm environment (first environment) in the vicinity of the first and second evaporator heat transfer element 28, 228 from a cold environment (second environment) in the vicinity of the first and second condenser heat transfer element 29, 229. The terms "warm" and "cold" refer to relative values, i.e. the warm environment is usually warmer than the cold environment.

Both duct walls 50, 52 can have a U-shaped form if their lateral ends shall form part of the flange 58.

Figure 4:
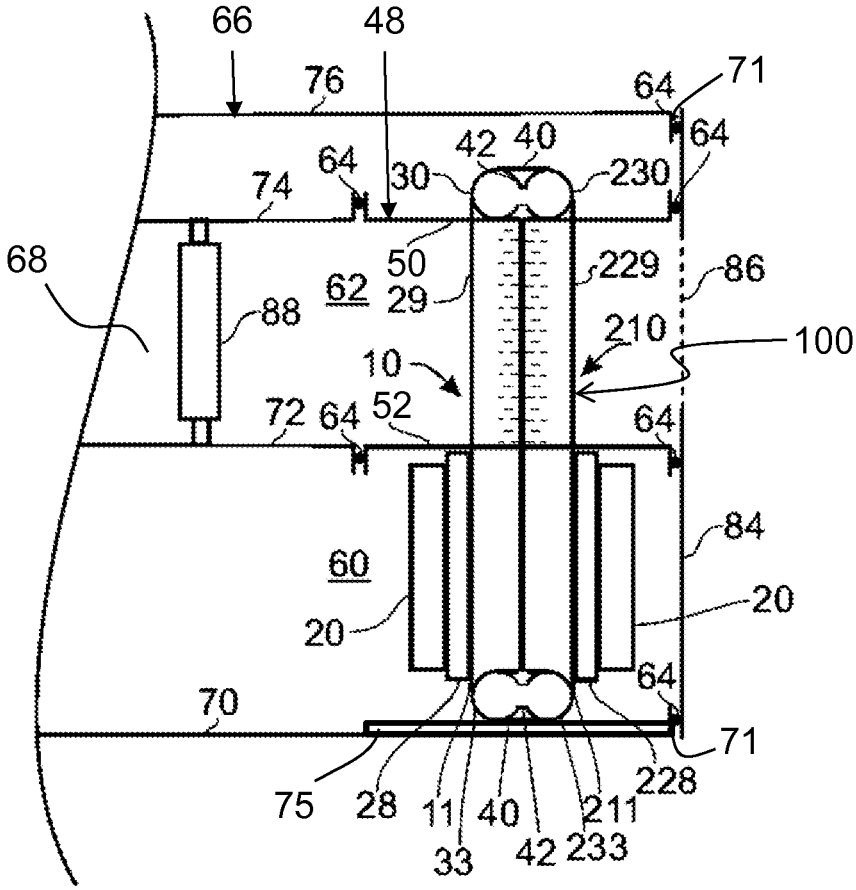
FIG. 4 is an embodiment of a traction converter according to the disclosure in a schematic cross-sectional view.

In FIG. 4, a traction converter according to an exemplary embodiment of the disclosure is shown in a schematic cross-sectional view. The traction converter of FIG. 4 includes the heat exchanger 1 of FIG. 3. Therefore, the heat exchanger 1 of FIG. 3 is not described in detail again.

The traction converter includes a clean room 60 and a dirty room 62. In the clean room 60 the first "hot" environment can be present. The heat sources 20 are arranged in the clean room 60. By arranging the heat sources 20 in the clean room 60, the IGBTs, power resistors or other electrical and electronic parts of the heat sources 20 can be shielded from dirt and humidity in the dirty room 62, where the second "cold" environment is present. The horizontally extending duct walls 50, 52 are sealed by the common seal 64. Moreover, the duct 48 is directly connected to the conduits 11 of the heat exchanger modules 10 in their condenser region. Thereby, an IP of 65 is achieved, i.e. the dirty room 62 can even be flooded with water without affecting the electronic components in the clean room 60.

Exemplary embodiments according to the disclosure can include further seals that are provided between the duct walls, in particular the lower duct wall 52 and the upper duct wall 50 and the conduits 11, 211 of the heat exchanger modules. Exemplary embodiments according to the disclosure can include a direct connection of the sealing plates to the conduits, for example, a welded connection or a glued connection, where required.

Similar to the embodiment of the power module shown and discussed with reference to FIG. 3, the traction converter shown in FIG. 4 can include an overall structure 66 in a box-type style through which an air duct 68 is led. In this exemplary embodiment of the traction converter shown in a simplified, partially cross sectional manner, the box-type overall structure 66 is delimited vertically by an upper cover 76 and a lower cover 70. The duct portion 48 of the power module 100 forms a portion of the air duct 68 of the overall structure 66 wherein a further lower duct wall 72 and a further upper duct wall 74 form the horizontal extension of the duct walls 50, 52 in FIG. 4. The cover 84 forms a front door or front panel of the overall structure 66. Similar to the flange 58 of the duct portion 48 the overall structure 66 forms a further sealing area together with the cover 84 in order to seal the interior of the traction converter with its power electronic against any rough environment outside the converter, for example, humid air. This ingress protection is achieved in that the overall structure forms a further flange portion 71. Both the upper cover 76 and the lower cover 70 have a U-shaped form if their lateral ends shall form part of the flange 58. At the same time the further flange portion 71 includes also a further seal 64, for example, an endless O-ring seal embedded in an appropriate groove.

In this embodiment the power module 100 with the heat exchanger 1 is insertable into and extractable out of overall structure 66 of the traction converter in a drawer-like manner. A guide 75 is provided for easing the inserting and extracting operation. Depending on the space available as well as on the overall mass of the power module, for example, the guide can be formed by a system of sliders running within a metal profile. Such a guide 75 would simplify the insertion and the extraction of the power module 100 into and out of the power converter, for example, if the first and the second heat exchanger modules are arranged relative to one another in a back-to-back matter, where power electronics such as IGBTs are thermally and mechanically connected to the heat transfer elements. Depending on the embodiment, the power module can include further a bus portion, for example, a low inductance bus bar or the like.

Focusing on the cooling of the heat exchanger 1, the heat exchanger 1 can be placed vertically in between the lower cover 70 and the upper cover 76 forming the recess with an opening to one side. In FIG. 4, the recess is opened to the right, wherein further exemplary embodiments include a mirror-inverted arrangement with an opening to the left. Thereby, the heat exchanger 1 can easily be replaced in case of a malfunction or maintenance where required. The interior volume of the traction converter is accessible and closable by the cover 84. The cover 84 is connected to the duct walls whereof the upper duct wall 50 and the lower duct wall 52 are displayed in FIG. 4. The cover 84 is perforated in order to form an air inlet for cool outside air forming the thermal carrier which is employed for receiving and removing the thermal load. As the cover 84 is forming an end face of the air duct 68 acting as the dirtier room 62 than the cleaner room 60, a particle filter 86 is mounted in the cover 84 to allow the ingress of air into the dirty room 62 of the duct. A fan 88 is arranged in the dirty room 62 for establishing a continuous air-flow through the condenser portions (i.e. the parts of the conduits 11 where the condenser heat transfer elements 29 are arranged) of the heat exchanger modules 10. With a vertical extension, for example a height of 500 mm of the heat exchanger 1 of the traction converter shown in FIG. 4, the whole traction converter can be arranged underneath the floor of a coach/wagon or on top of the roof of a coach.

Due to the back-to-back-arrangement with the fluid connections in the distributor manifolds, exemplary embodiments according to the disclosure can have a high thermal efficiency even for the exchanger module which is located downstream in the air-flow. The exchanger module being arranged downstream is confronted with warmer cooling air than the exchanger module being arranged upstream. However, liquid working fluid from the lower distribution manifold of the upstream exchanger module can enter the lower distribution manifold of the downstream exchanger module, thus providing an additional cooling for the downstream exchanger module. Therefore, both heat exchanger modules can work with suitable conditions providing a suitable cooling for the electronic components.

A first exchanger module 10 according to an exemplary embodiment of the disclosure is now described with reference to FIG. 5. The second exchanger module 210, of the exemplary embodiments, can be identical to the first heat exchanger module 10.

Figure 5:
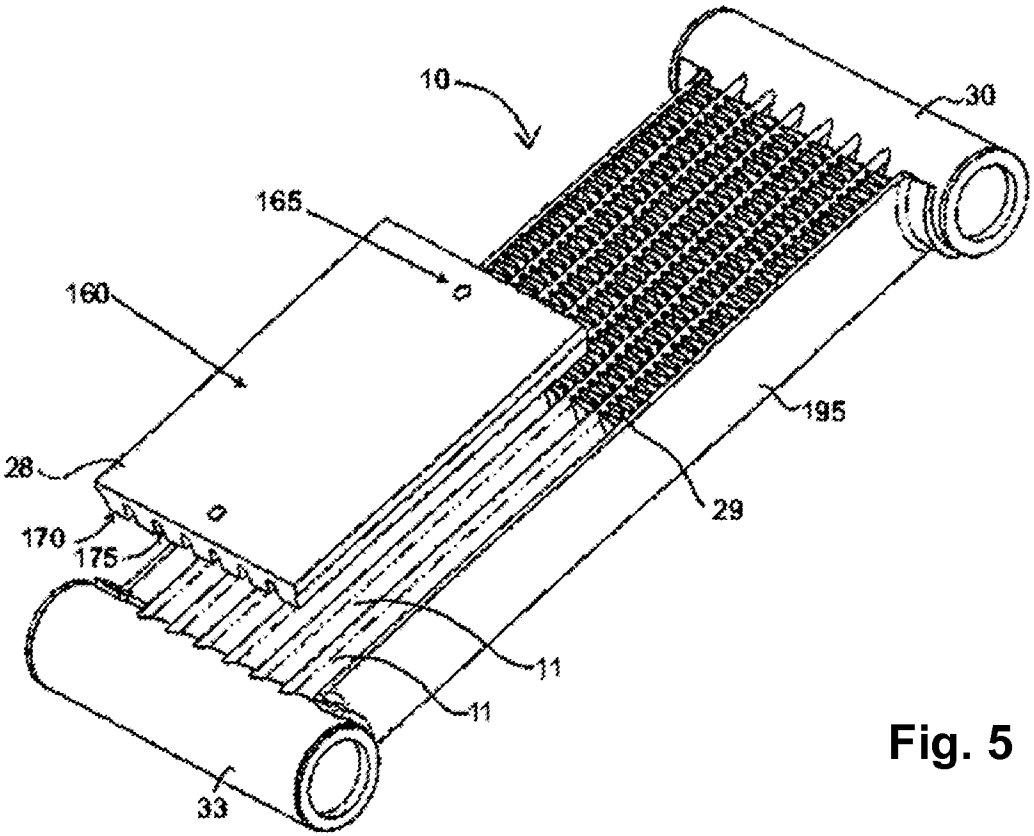
FIG. 5 shows an exemplary heat exchanger module according to the disclosure for the exemplary embodiments of FIG. 1 or 3.

As shown in FIG. 5 the first exchanger module 10 includes a plurality of conduits 11 for a working fluid, each having an exterior wall 112 and each having interior walls 114 (see FIG. 7) for forming the first evaporator channels 120 and the first condenser channels 130 within the conduit 11. Furthermore, the exchanger module 10 includes a first evaporator heat transfer element 28 for transferring heat into the first evaporator channels 120 and a first condenser heat transfer element 29 for transferring heat out of the first condenser channels 130. The first conduits 11 are arranged in a vertical position but other positions of at least 45° (degrees inclination) are possible. The first evaporator channels 120 and the first condenser channels 130 are aligned in parallel in the first conduits 11.

Figure 6:
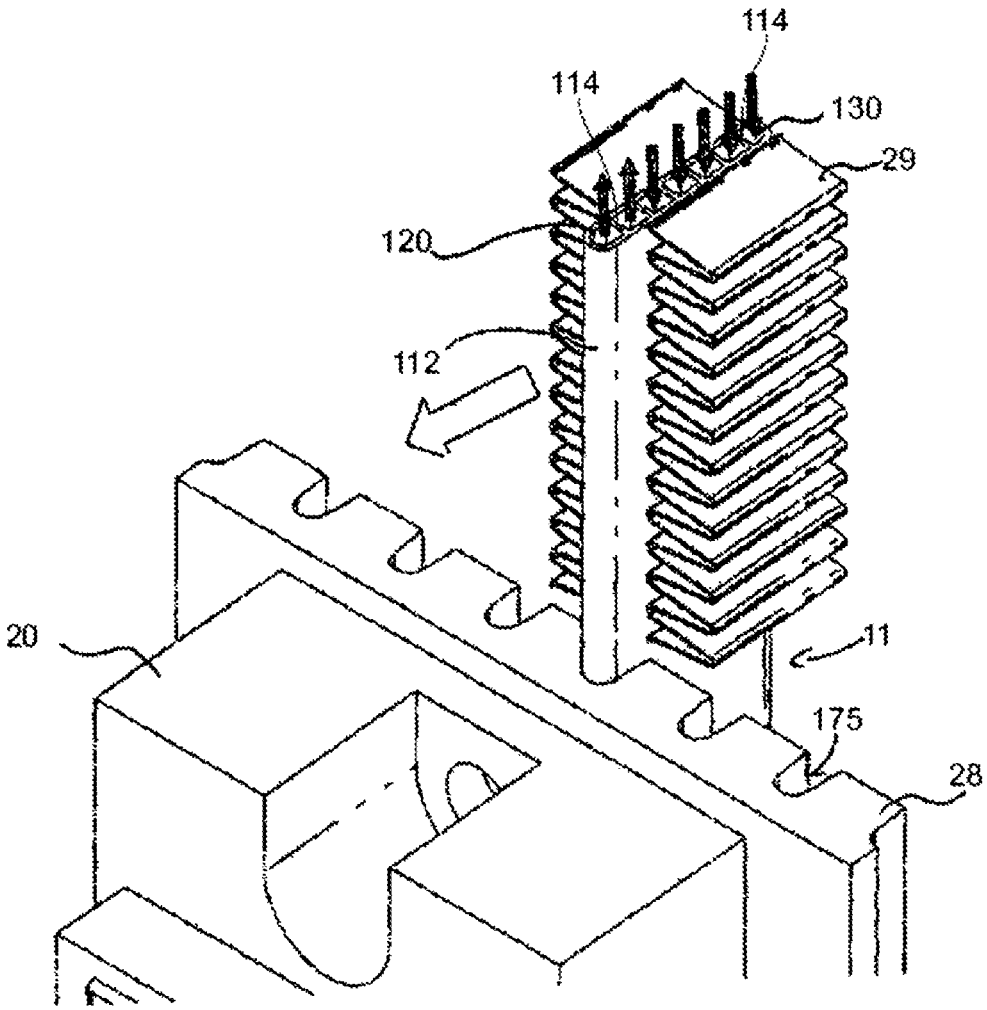
FIG. 6 shows details of the heat exchanger module of FIG. 5 in a partly cross-sectional schematic view.

In the exemplary embodiment according to the disclosure shown in FIG. 6, the first evaporator heat transfer element 28 includes a mounting element having a mounting surface 160 for mounting a heat source, for example, a semiconductor power unit or the like, and a contact surface 170 for establishing a thermal contact to a portion of the exterior wall 112 of the first conduit 11 associated with the first evaporator channel 120.

In particular, in the embodiment shown in FIG. 6, the first evaporator heat transfer element 28 takes the form of a base plate having a planar mounting surface 160, for mounting the heat source, and a contact surface 170 opposite to the mounting surface, including grooves 175 conforming to the exterior walls 112 of the first conduits 11. In other words, the grooves 175 are shaped and sized such that the first conduits 11 can fit in snugly. Furthermore, the first condenser heat transfer element 29 includes cooling fins provided on exterior walls 112 of the conduits 11. Two header tubes, used as a first upper distribution manifold 30 and a first lower distribution manifold 33, are connected to each end of the first conduits 11. In case the heat source 20 dissipates heat, the working fluid ascends within the first evaporator channels 120 to the first upper distribution manifold 30 and from there to the first condenser channels 130, where the fluid condenses and drops to the first lower distribution manifold 33.

In the embodiment shown in FIG. 6, the first conduits 11 take the form of flat multi-port extruded aluminum tubes having an oblong overall cross section. Thereby, the planar exterior sidewalls of the flat tube are oriented perpendicular to the planar mounting surface 160 of the first evaporator heat transfer element 28. In exemplary embodiments according to the disclosure, two support bars 195 are also attached at the side ends of the assembly to strengthen the assembly and to guide cooling air to the first condenser heat transfer element 29. The first evaporator heat transfer element 28 includes two mounting holes 165 for mounting electrical or electronic components.

Heat exchanger modules, according to exemplary embodiments of the disclosure, work with the loop thermosyphon principle. The heat exchanger is charged with a working fluid. Any refrigerant fluid can be used; some examples are R134a, R245fa, R365mfc, R600a, carbon dioxide, methanol and ammonia. The exchanger module is mounted vertically or with a small angle from the vertical such that the fins of the condenser heat transfer elements are situated higher than the evaporator heat transfer elements. The amount of fluid inside is normally adjusted such that the level of liquid is not below the upper level of the evaporator heat transfer elements.

The heat generated by the electrical components 20 moves to the base-plate portion with the grooves 175 of the first evaporator heat transfer element 28 to the front side of the first conduits 11 by heat conductance. As can be seen from FIG. 6 only the sections of the first conduits 11 that are covered by the grooves 175, i.e. the first evaporator channels 120, directly receive the heat. The first evaporator channels 120 are fully or partially filled with the working fluid. The fluid in the first evaporator channels 120 evaporates due to the heat and the vapor rises up in the first evaporator channels 120. Some amount of liquid is also entrained in the vapor stream and will be pushed up in the first evaporator channels 120. Above the upper level of the first evaporator heat transfer element 28, the first conduits 11 have air-cooling fins as first condenser heat transfer elements 29 on both sides.

The fins mounted to the conduits can be cooled by a convective air flow, commonly generated by a cooling fan or blower (see FIG. 4). It is also possible to use natural convection. In the case of natural convection, it would be preferred to install the system with an increased angle from the vertical. The mixture of vapor and liquid inside the evaporator channels reaches the upper distribution manifold and then flows down the condenser channels. While going through the condenser channels, vapor condenses back into liquid since the channels transfer heat to the fins. The liquid condensate flows down to the lower distribution manifold and flows back into the evaporator channels, closing the loop. As with thermosyphon-type devices, air (and other non-condensable gases) inside can be evacuated (i.e. discharged) and the system is partially filled (i.e. charged) with a working fluid. For this reason discharging and charging valves (not shown) are included in the assembly. The free ends of the distribution manifolds are suitable locations for such valves. A single valve can also be utilized for both charging and discharging. Alternatively, the heat exchanger can be evacuated, charged and permanently sealed.

Figure 7:
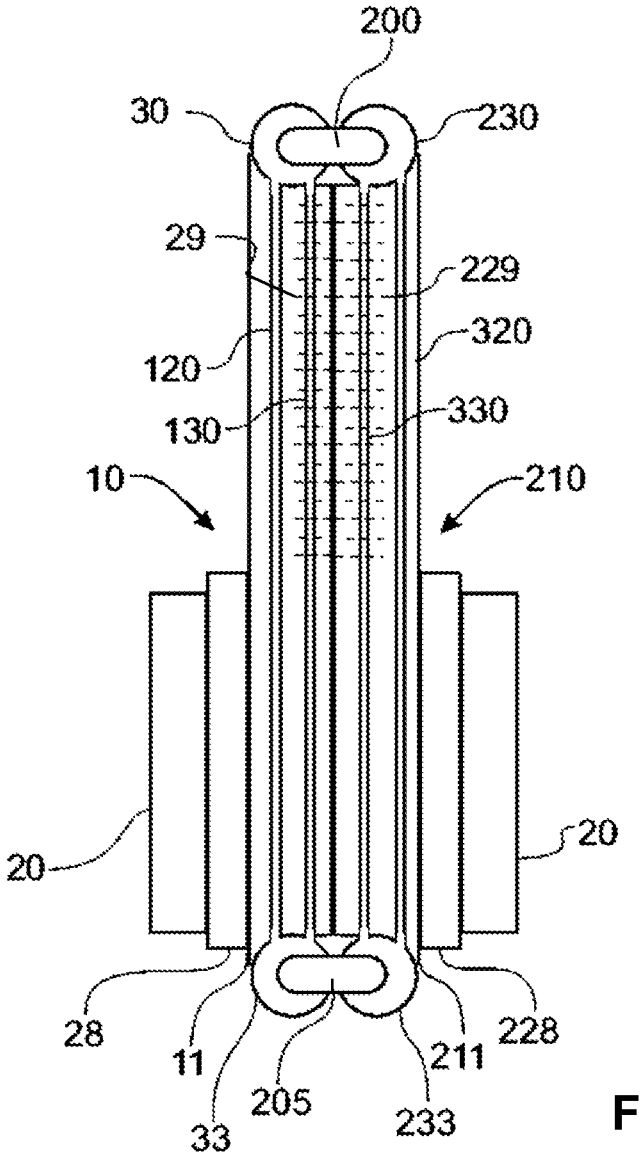
FIG. 7 is a schematic cross-sectional view of an embodiment of a heat exchanger according to the disclosure.

In the embodiment shown in FIG. 6, the cooling fins of the first condenser heat transfer elements 29 can be provided only on a portion of the exterior wall 112 of the first conduit 211 associated with the first condenser channels 130 because only that portion of the first conduit 211 shall serve as a condenser portion of the thermosyphon. In FIG. 7, also the interior walls 114 dividing the first evaporator channels 120 and the first condenser channels 130 are shown. FIG. 7 is a simplified schematic kind of view that does not strictly match a proper sectional view.

The skilled reader will recognize that the present disclosure extends to exemplary embodiments with more than two heat exchanger modules whose condenser regions are stacked such that they were to be cooled by a thermal carrier streaming through the condenser portions in a sequential manner. Moreover, the skilled reader will notice that the present disclosure encompasses exemplary embodiments of heat exchangers whose heat exchanger modules can have a different number and kind of first conduits. In addition the skilled reader will notice that the present disclosure encompasses exemplary embodiments of heat exchangers whose evaporator channels and condenser channels are provided in structurally different conduits, for example, where the evaporator channels were dedicated an MPE profile of their own while the condenser channels were dedicated another MPE profile of their own.

In exemplary embodiments, the first and second evaporator heat transfer elements can be made of a highly thermally conductive material such as aluminum or copper. It can be manufactured using extrusion, casting, machining or a combination of such common processes. The first and second evaporator heat transfer elements need not be made to the exact size of the conduits assembly. In some exemplary embodiments according to the disclosure it can be made larger in order to add thermal capacitance to the system. One side of the plate is contacting the conduits. The first and second evaporator heat transfer elements have grooves on this side that partially cover the multi-port conduits as shown in FIG. 6. The channels can be shaped to conform to the first and second conduits. The other side of the plate is made flat to accept plate mounted heat-generating components as heat sources, such as power electronics circuit elements (for example, IGBT, IGCT, Diode, Power Resistors etc.). Mounting holes with or without threads are placed on the flat surface to bolt down the components. The conduits can have a symmetric layout of the internal channels, whereby the up-going and down-coming streams in the loop thermosyphon configuration share the same conduit. In exemplary embodiments according to the disclosure, the channels for these two streams can be designed independently. For example, the largest pressure drop in the flow of the refrigerant vapor-liquid mixture can be created inside the evaporator channels. For this reason it can be suitable to allocate larger channel cross-sectional area to these channels. For the condenser channels, smaller channels with internal walls or dividing walls or additional fin-like features on the inner-wall surfaces would be suitable to increase the inner channel surface thus increasing the heat-transfer surface. When using different size channels inside the multi-port tube it can be necessary also to have different wall thickness around the periphery of the tube so that all sections are equally strong against internal pressure. For example, the wall thickness around a larger sized evaporator channel can be increased while using a thinner wall thickness around the small condenser channels. In comparison to using a uniformly thick evaporator thickness, this approach can save on material costs. Known wall thicknesses used in commercially available aluminum multi-port extruded conduits are in the order of 0.2 to 0.75 mm.

The components of the heat exchanger modules can be joined together in a one-shot oven brazing process. Soldering and brazing of aluminum onto aluminum can be challenging because of the oxide layer on aluminum that prevents wetting with solder alloy. There are various methods employed to accomplish this task. Often, the base aluminum material is covered with an AlSi brazing alloy (also called the cladding) that melts at a lower temperature (around 590° C.) than the base aluminum alloy. The aluminum tubes are extruded with the cladding already attached as a thin layer. A flux material is also applied on the tubes, either by dipping the tubes into a bath or by spraying. When the parts are heated in the oven, the flux works to chemically remove the oxide layer of the aluminum. The controlled atmosphere contains negligible oxygen (nitrogen environment is commonly used) so that a new oxide layer is not formed during the process. Without the oxide layer, the melting brazing alloy is able to wet the adjacent parts and close the gaps between the assembled components. When the parts are cooled down, a reliable and gas-tight connection can be established. Furthermore, the cooling fins and the tubes can also be bonded to ensure a good thermal interface between them. Assembling the whole device and brazing it at one shot would ensure that the channels on the first and second evaporator heat transfer element are matching the location of the first and second conduits, respectively. Alternatively, a second, lower temperature soldering process can be employed to join the evaporator heat transfer elements with the conduits after the heat exchanger module cores are brazed. The lower temperature soldering is a good measure to make sure that the brazed joints do not come off during re-heating for soldering.

Exemplary embodiments use flat, multi-port conduits with louvered fins. The flat conduits introduce less pressure drop to the air flow compared to round tubes. In addition, the multi-port design increases the internal heat-transfer surface. Louvered fins increase the heat-transfer coefficient without significant increase in pressure drop (louvers are twisted slits on the fin's surface). The fins are cut from a strip of sheet aluminum and bent into an accordion-like shape. The pitch between the fins can be easily adjusted during assembly by "pulling on the accordion." Two round header tubes at the ends of the flat conduits constitute the distribution manifolds. The stacking and assembly of all these elements of the heat-exchanger core can be done in a fully automated way.

FIG. 7 is a schematic cross-sectional view of a further exemplary embodiment of a heat exchanger 1 according to the disclosure. Again, identical reference signs are used for similar or identical parts shown in FIGS. 1-6. The heat exchanger 1 of FIG. 7 includes a fluid connection element formed by an upper connecting pipe 200 for connecting the upper distribution manifolds 30, 230 and a lower connecting pipe 205 for connecting the lower distribution manifolds 33, 233. Both the upper connecting pipe 200 and the lower connecting pipe 205 are shown in front view in FIG. 7 and not in sectional view.

Exemplary embodiments according to the disclosure include upper or lower connecting pipes for establishing fluid connections between the distribution manifolds of back-to-back arranged heat exchanger modules. The use of connecting pipes allows a flexible adaption of the heat exchanger with its advantageous thermodynamic properties to different mounting dimensions. The connecting pipes can be mounted at the upper or at the lower end of the heat exchanger modules. Exemplary embodiments include upper and lower connecting pipes to form a thermal compensation loop between the heat exchanger modules. Hence, the loops of the heat exchanger modules are enhanced by adding a second type of loop for a thermal compensation. By doing so, the overall performance of densely arranged heat exchangers can be improved.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE NUMERALS

10 First heat exchanger module
11 First conduit
20 Heat source
28 First evaporator heat transfer element
29 First condenser heat transfer element
30 First upper distribution manifold
33 First lower distribution manifold
40 Manifold connector
42 Connecting holes
44 thermal carrier, e.g. air
48 air duct portion
50 Upper duct wall
52 lower duct wall
58 flange
59 fastening means
60 Clean room (first environment)
62 Dirty room (second environment)
64 Seal
66 overall structure
68 air duct
70 Lower cover
71 further flange portion
72 further lower duct wall
74 further upper duct wall
75 guiding means
76 Upper cover
84 Cover plate
86 Particle filter
88 Fan
100 Power module
112 Exterior wall of conduit
114 Interior wall of conduit
120 First evaporator channel
130 First condenser channel
160 Mounting surface
165 Mounting hole
170 Contact surface
175 Groove
183 Heating fin
195 Support bar
200 Upper connecting pipe
205 Lower connecting pipe
210 Second heat exchanger module
211 Second conduit
228 Second evaporator heat transfer element
229 Second condenser heat transfer element
230 Second upper distribution manifold
233 Second lower distribution manifold
320 Second evaporator channel
330 Second condenser channel

What is claimed is:

1. A heat exchanger, comprising: a first heat exchanger module including: a first evaporator channel and a first condenser channel wherein the first evaporator channel and the first condenser channel are arranged in a first conduit and wherein the first evaporator channel and the first condenser channel are fluidly connected to one another by a first upper distribution manifold and a first lower distribution manifold such that the first evaporator channel and the first condenser channel form a first loop for a working fluid; a first evaporator heat transfer element for transferring heat into the first evaporator channel; and a first condenser heat transfer element for transferring heat out of the first condenser channel; and a second heat exchanger module coupled to the first heat exchanger module by a fluid connection element for an exchange of the working fluid between the first heat exchanger module and second heat exchanger module, the second heat exchanger module including: a second evaporator channel and a second condenser channel, wherein the second evaporator channel and the second condenser channel are arranged in a second conduit and the second evaporator channel and the second condenser channel are fluidly connected to one another by a second upper distribution manifold and a second lower distribution manifold such that the second evaporator channel and the second condenser channel form a second loop for the working fluid, the second condenser channel is arranged opposite to the first evaporator channel with respect to the first condenser channel when seen in a cross sectional plane to which the first condenser channel and the second condenser channel and the first evaporator channel are projected.

2. The heat exchanger according to claim 1, wherein the first heat exchanger module and the second heat exchanger module are both arranged to be operable independently of one another.

3. The heat exchanger according to claim 1, wherein the first condenser channel and the second condenser channel are arranged between the first evaporator channel and the second evaporator channel when seen in a cross sectional plane to which the first condenser channel and the second condenser channel and the second evaporator channel are projected.

4. The heat exchanger according to claim 1, wherein the first upper distribution manifold is connected to an upper end of the first conduit and wherein the second upper distribution manifold is connected to an upper end of the second conduit, the first upper distribution manifold and the second upper distribution manifold being connected by an upper fluid connection.

5. The heat exchanger according to claim 4, wherein the first lower distribution manifold is connected to a lower end of the first conduit and wherein the second lower distribution manifold is connected to a lower end of the second conduit, the first lower distribution manifold and the second lower distribution manifold being connected by a lower fluid connection.

6. The heat exchanger according to claim 1, the first heat exchanger module comprising:

a plurality of first conduits arranged in parallel such that the first evaporator channels are arranged side by side and the first condenser channels are arranged side by side.

7. The heat exchanger according to claim 1, the heat exchanger comprising:

at least one of a second evaporator heat transfer element for transferring heat into the second evaporator channel and a second condenser heat transfer element for transferring heat out of the second condenser channel.

8. The heat exchanger according to claim 5, the fluid connections comprising:

connecting holes arranged in at least one of an exterior wall of the lower distribution manifolds and in an exterior wall of the upper distribution manifolds.

9. The heat exchanger according to claim 5, the fluid connections comprising:

at least one of an upper connecting pipe for connecting the upper distribution manifolds and a lower connecting pipe for connecting the lower distribution manifolds.

10. The heat exchanger according to claim 1, comprising:

a duct portion for separating a first environment from a second environment wherein the first evaporator heat transfer element is arranged in the first environment;

and wherein a portion of the first conduit is arranged in the second environment.

11. The heat exchanger according to claim 1, the first conduit comprising:

a plurality of first evaporator channels and a plurality of first condenser channels.

12. A power module in combination with a heat exchanger according to claim 1, comprising:

at least one semiconductor unit is thermally connected to the first evaporator heat transfer element in combination with the heat exchanger.

13. A traction converter in combination with at least one power module according to claim 12.

14. The traction converter according to claim 13, comprising:

an overall structure and duct portion for separating a first environment and a second environment provided in the overall structure, wherein an air quality of the second environment is lower than an air quality of the first environment;

wherein the first evaporator heat transfer element of the heat exchanger is arranged in the first environment and a portion of the first conduit is arranged in the second environment.

15. The traction converter according to claim 13, the power module being arranged insertable into the overall structure and extractable off the overall structure by a guide in a drawer-like manner;

wherein an airtight seal is provided in between the duct portion, the overall structure and a movable enclosure cover of the overall structure if the heat exchanger is fully inserted into the traction converter.

* * * * *